United States Patent [19]

Chambers

[11] Patent Number: 4,907,603

[45] Date of Patent: Mar. 13, 1990

[54] SAFETY SMOKE

[75] Inventor: Thomas E. Chambers, Gainesville, Ga.

[73] Assignee: Bertha D. Chambers, Gainesville, Ga.

[21] Appl. No.: 115,833

[22] Filed: Jan. 4, 1988

[51] Int. Cl.[4] ..... A24F 13/16

[52] U.S. Cl. ..... 131/175; 131/329; 131/238; 131/240.1; 131/242; 131/242.5; 131/242.6

[58] Field of Search ..... 131/329, 242.6, 17.5, 131/238, 242.5, 240.1, 242

[56] References Cited

U.S. PATENT DOCUMENTS

| | | | |
|---|---|---|---|
| 2,850,020 | 9/1958 | McShane | 131/175 |
| 4,027,680 | 6/1977 | DeMarco | 131/175 |
| 4,236,539 | 12/1980 | Mosby | 131/175 |
| 4,570,645 | 2/1986 | Newman et al. | 131/175 |
| 4,660,575 | 4/1987 | Andreason et al. | 131/175 |

*Primary Examiner*—Vincent Millin

[57] ABSTRACT

A cigar or cigarette holder comprising a cylindrical housing having an access to remove ashes, an access to insert cigarettes, vent holes, an opening in the housing so as to facilitate the lighting of the cigar or cigarette and a grill rack on the interior wall of the housing so as to hold the cigarette and catch any ash. Also provided is a cigarette cassette.

1 Claim, 1 Drawing Sheet

SAFETY SMOKE

BACKGROUND OF THE INVENTION

The invention pertains to a cigar or cigarette holder that guards the environment from the lit end of a cigar or cigarette and the ash produced.

SUMMARY OF THE INVENTION

The holder comprises a cylindrical housing which encases the cigarette. The housing can be constructed from aluminum or other non-flammable materials. The housing comprises vent holes for the exchange of smoke and ambient air and an opening for lighting a cigar or cigarette.

DETAILED DESCRIPTION OF THE INVENTION

Figure 1:
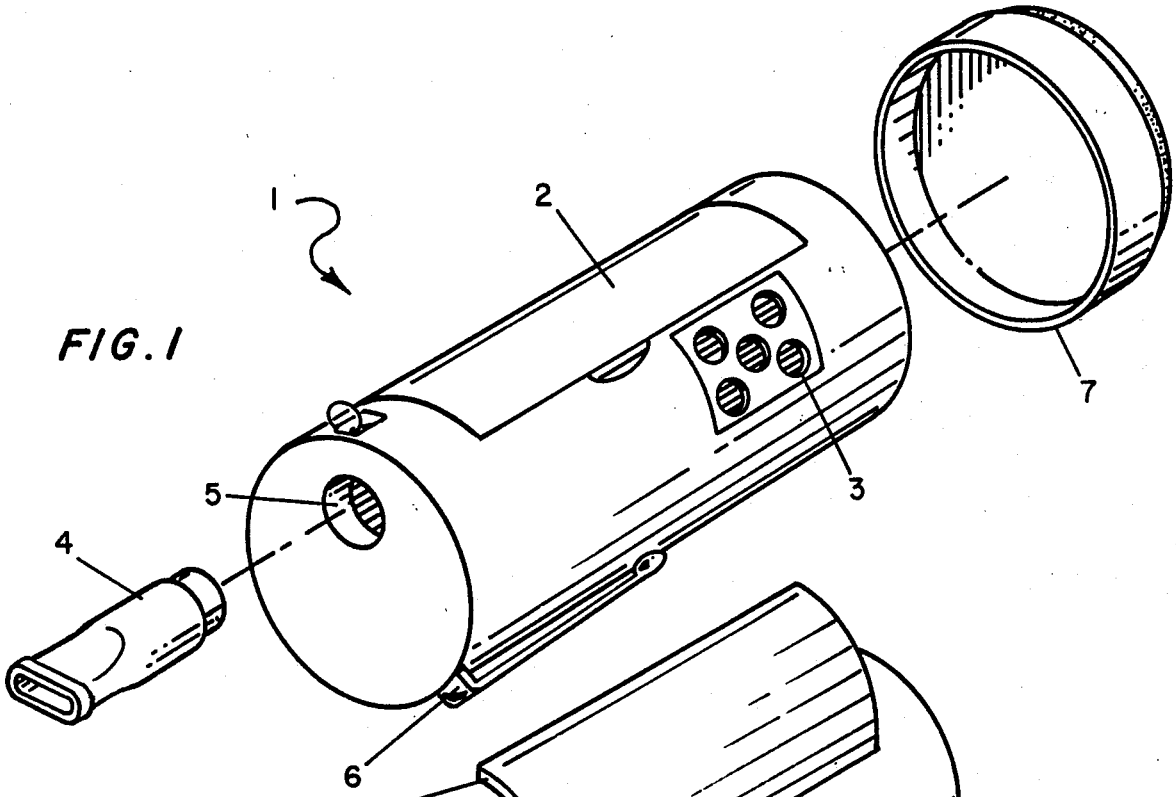
FIG. 1 illustrates the holder with its associated lighting end opposite the mouthpiece end.
Figure 2:
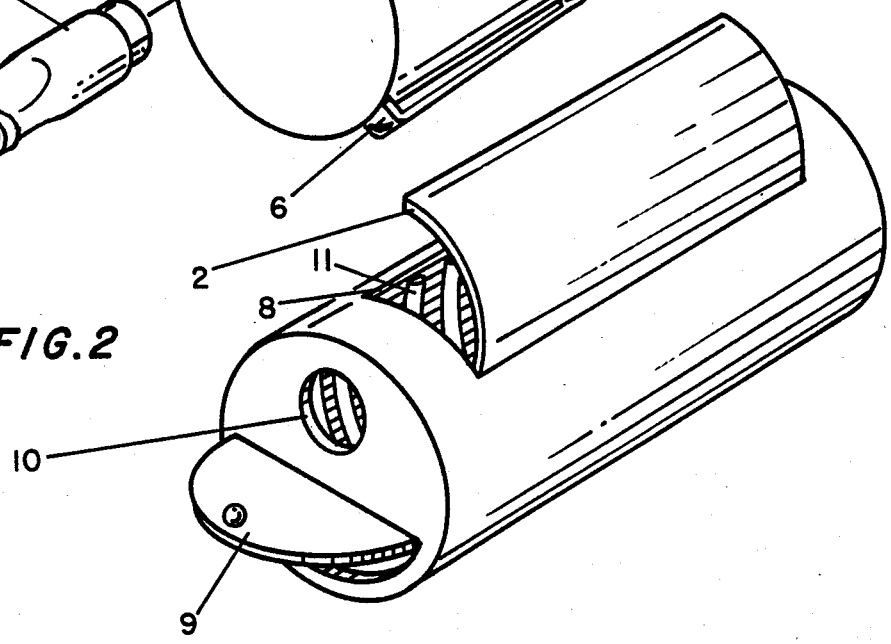
FIG. 2 illustrates the holder of FIG. 1 and its lighting end.
Figure 3:
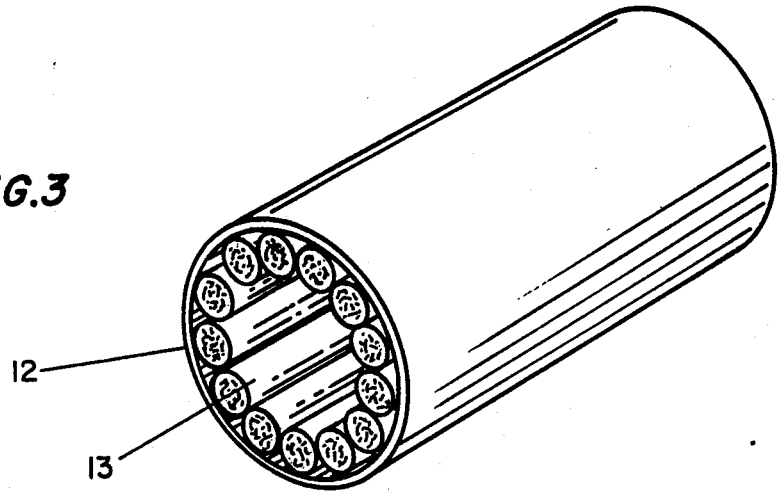
FIG. 3 illustrates a cigarette cassette.

FIG. 1 illustrates a holder comprising a cylindrical housing (1) a hinged door (2) in the closed position, an array of vent holes (3), a mouthpiece (4), a socket (5) in the holder for receiving mouthpiece (4) and a clip (6). Also included in FIG. 1 is a separate coaster (7) with adhesive on the bottom. This will allow the coaster to be attached to a surface such as a dashboard in a car and adapted to hold the holder. FIG. 2 illustrates the holder illustrated in FIG. 1. As opposed to FIG. 1, FIG. 2 illustrates the opposite end of the holder. The holder in FIG. 2 illustrates the hinged door (2) in an opened position exposing the interior of the holder through access (8), an ash release door (9) so as to facilitate the removal of ash from the interior of the housing, an opening (10) for lighting the cigarette or for accommodating lighter (not illustrated) and a grill type rack (11) on the interior walls of the housing for supporting the cigar or cigarette and allowing formed ashes to fall freely from the cigarette. Both hinged doors (2 and 9) are provided with a safety clip or catch (not illustrated) so as to prevent accidental openings. FIG. 3 illustrates a cigarette cassette comprising housing (12) with cigarettes (13) accommodated therein. Mouthpiece (4) can contain a filter and said filters may be provided with flavorants. Also, the holder may have an attachment for a necklace or chain.

What is claimed is:

1. A cigar or cigarette holder having a mouthend and a lighting end comprising a cylindrical housing having an internal diameter of such size so as to accommodate a cigar or cigarette; said housing on its cylindrical surface having an access of such size so that a cigar or cigarette can be inserted into said housing; said access having a first door fitted therein and hinged to said housing; said first door permits access into said housing when in an open position or closes off the interior of said housing from the outside of said housing when in a closed position; an array of vent holes provided adjacent to said access on said surface so as to allow for the exchange of smoke and ambient air; a clip provided on said housing so as to allow said housing to be attached to a pocket on a users apparel; said mouthend having a socket adapted to fit a mouthpiece; a mouthpiece fitted in said socket; said mouthpiece providing fluid communication between the interior of the housing and the exterior of said housing; said lighting end having a first and second opening; said first opening communicating with the interior of said housing and adapted for lighting the cigar or cigarette in said housing or for accommodating a lighter; said second opening, adjacent said first opening, adapted to allow for the removal of ashes in said housing; said second opening having a second door fitted therein and hinged to said housing; said second door adapted to facilitate the removal of ashes when in an opened position and to retain ashes in said housing when in a closed position; a grill rack provided on the interior walls of the cylindrical housing so as to support a cigar or cigarette and allow ashes to fall freely from the cigar or cigarette.

* * * * *